US009376977B2

(12) United States Patent
Methil-Sudhakaran et al.

(10) Patent No.: US 9,376,977 B2
(45) Date of Patent: Jun. 28, 2016

(54) RAIL PRESSURE CONTROL STRATEGY FOR COMMON RAIL FUEL SYSTEM

(75) Inventors: Nandagopal Methil-Sudhakaran, Dunlap, IL (US); Daniel R. Puckett, Peoria, IL (US); Frank Lombardi, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 936 days.

(21) Appl. No.: 13/606,479

(22) Filed: Sep. 7, 2012

(65) Prior Publication Data

US 2014/0074382 A1 Mar. 13, 2014

(51) Int. Cl.

| | |
|---|---|
| ***F02D 41/04*** | (2006.01) |
| ***F02D 41/14*** | (2006.01) |
| ***F02D 41/38*** | (2006.01) |
| *F02M 59/34* | (2006.01) |
| *F02M 63/02* | (2006.01) |

(52) U.S. Cl.

CPC ..... *F02D 41/1401* (2013.01); *F02D 41/3845* (2013.01); *F02D 2041/142* (2013.01); *F02D 2041/1409* (2013.01); *F02D 2041/1418* (2013.01); *F02D 2041/1422* (2013.01); *F02D 2041/1432* (2013.01); *F02D 2200/0602* (2013.01); *F02D 2250/31* (2013.01); *F02M 59/34* (2013.01); *F02M 63/0265* (2013.01)

(58) Field of Classification Search

CPC ..... F02M 63/0025; F02M 63/023; F02M 63/0265; F02M 59/022; F02M 59/34; F02M 59/366; F02M 59/447; F02M 59/46; F02M 59/466; F02D 2250/31; F02D 41/04; F02D 41/045; F02D 41/14; F02D 2041/1401; F02D 2041/1402; F02D 2041/1408; F02D 2041/1409; F02D 2041/142; F02D 2041/1418; F02D 2041/1422

USPC ..... 123/458, 494, 198 D, 446–447, 497

See application file for complete search history.

(56) References Cited

U.S. PATENT DOCUMENTS

| | | | | |
|---|---|---|---|---|
| 5,315,976 | A * | 5/1994 | Birk | F02D 41/14 123/198 D |
| 5,505,180 | A * | 4/1996 | Otterman | F02D 41/2464 123/497 |
| 5,507,266 | A | 4/1996 | Wright et al. | |
| 5,609,136 | A | 3/1997 | Tuken | |
| 5,771,861 | A * | 6/1998 | Musser | F02D 41/1401 123/357 |
| 6,098,322 | A | 8/2000 | Tozawa et al. | |
| 6,155,233 | A * | 12/2000 | Wade | F02M 59/466 123/458 |

(Continued)

FOREIGN PATENT DOCUMENTS

| | | |
|---|---|---|
| CA | 2754183 | 1/2012 |
| DE | 3731983 | 4/1989 |

(Continued)

*Primary Examiner* — Thomas Moulis

(74) *Attorney, Agent, or Firm* — Liell & McNeil Attorneys P.C.; John P. Wappel

(57) ABSTRACT

A common rail fuel system includes a common rail supplied by an inlet metered high pressure pump and fluidly connected to a plurality of zero-leak fuel injectors. An electronic controller controls pressure in the common rail predominantly responsive to a rail pressure error when outside of an overshoot avoidance condition corresponding to the error being less than a first threshold and a time rate of change of the error being greater than a second threshold. Pressure in the common rail is controlled predominantly responsive to the time rate of change of the error during the overshoot avoidance condition.

14 Claims, 3 Drawing Sheets

(56) References Cited

U.S. PATENT DOCUMENTS 6,293,757 B1 * 9/2001 Oda ..... F02D 41/3845 123/447
6,450,147 B2 9/2002 Demura et al.
6,497,223 B1 * 12/2002 Tuken ..... F02D 33/006 123/456
6,840,220 B2 * 1/2005 Yomogida ..... F02D 41/3809 123/456
6,971,368 B2 * 12/2005 Uchiyama ..... F02D 41/221 123/359
7,066,149 B1 * 6/2006 Date ..... F02D 33/006 123/447
7,076,954 B1 7/2006 Sopko, Jr. et al.
7,848,868 B2 12/2010 Nakagawa et al.
7,921,702 B2 * 4/2011 Williams ..... F02D 41/1401 73/114.43
7,938,101 B2 * 5/2011 Cinpinski ..... F02D 41/2467 123/446
7,950,371 B2 * 5/2011 Cinpinski ..... F02D 41/221 123/446
8,239,118 B2 * 8/2012 Dintino ..... F02D 41/2464 123/446
8,707,932 B1 * 4/2014 Marin ..... F02D 41/3082 123/479
8,844,501 B2 * 9/2014 Dolker ..... F02D 41/3845 123/457
9,046,052 B2 * 6/2015 Eser ..... F02D 41/3863
2001/0023616 A1 * 9/2001 Wade ..... F02M 63/0225 73/756
2002/0117152 A1 * 8/2002 Fallahi ..... F02D 41/20 123/490
2002/0139350 A1 * 10/2002 Barnes ..... F02D 41/1401 123/456
2004/0055575 A1 * 3/2004 McCarthy, Jr. ..... F02D 41/1498 123/457
2004/0055576 A1 * 3/2004 McCarthy, Jr. ..... F02D 41/0087 123/458
2007/0090199 A1 * 4/2007 Hull ..... F24F 11/006 236/49.3
2007/0125343 A1 * 6/2007 Hayakawa ..... F02D 41/221 123/447
2008/0059039 A1 * 3/2008 Nakagawa ..... F02D 41/3863 701/99
2012/0215421 A1 * 8/2012 Maruyama ..... F02D 41/3845 701/104
2012/0215422 A1 * 8/2012 Sugiyama ..... F02D 41/3845 701/104

FOREIGN PATENT DOCUMENTS

JP 11247683 9/1999
JP 2011153552 8/2011

* cited by examiner

RAIL PRESSURE CONTROL STRATEGY FOR COMMON RAIL FUEL SYSTEM

TECHNICAL FIELD

The present disclosure relates generally to controlling rail pressure in a common rail fuel system, and more particularly to special control logic during specific operating conditions.

BACKGROUND

Most modern common rail fuel systems utilize an electronically controlled high pressure pump to control fuel pressure in a common rail that is fluidly connected to a plurality of fuel injectors. Effective control of an engine utilizing a common rail fuel system centers on precise control over rail pressure, fuel injection timings and fuel injection quantities. Most manufacturers utilize some form of a feedback control strategy, such as a proportional integrator derivative (PID) controller to control output of a high pressure pump to in turn control fuel pressure in the common rail. For instance, U.S. Pat. No. 5,507,266 teaches a PID controller to control pressure in a common rail fuel system for a spark ignited engine. In almost all common rail fuel systems, the high pressure pump is driven directly by the engine, but output of the pump may be controlled either by some variable displacement strategy, spill control valves and even an inlet metered strategy. Depending upon the particular high pressure pump strategy chosen, different control issues can arise as different pump hardware behave differently in real engine applications. For instance, some pumps may be less expensive, but may exhibit more hysteresis than other pump hardware.

Finding a good balance between cost and effective rail pressure control can further be complicated by recent improvements to fuel injectors to improve efficiency. In many cases, electronically controlled fuel injectors utilize liquid fuel not only as an injection medium, but also as a control fluid. The fuel utilized to control operation of the fuel injector is typically returned to tank for recirculation during injection events. Between injection events, manufacturers have sought to improve efficiency by reducing leakage in fuel injectors through a variety of strategies, including better control valve seating and tighter tolerances in guide clearances separating high pressure areas from low pressure areas within the fuel injector. As fuel injectors become better at avoiding leakage, rail pressure control problems can become acute because common rail supply pumps can only control pressure by changing the pump output to be greater or less, but cannot remove fuel from the common rail in order to lower pressure in the same. Thus, depending upon the specific hardware in a common rail fuel system, providing a cost effective strategy for precisely controlling rail pressure can be problematic.

The present disclosure is directed toward one or more of the problems set forth above.

SUMMARY

In one aspect, a method of controlling pressure in a common rail of a common rail fuel system includes determining an error between an actual rail pressure and a target rail pressure, and determining a time rate of change of the error. Fuel is supplied to the common rail from an electronically controlled pump, while fuel is removed from the common rail responsive to injecting fuel from a plurality of fuel injectors. Pressure in the common rail is controlled predominantly responsive to the error, when outside of an overshoot avoidance condition corresponding to the error being less than the first threshold and the time rate of change of the error being greater than a second threshold. Pressure in the common rail is controlled predominantly responsive to the time rate of change of the error during the overshoot avoidance condition.

In another aspect, a common rail fuel system includes a common rail with an inlet and a plurality of outlets. A plurality of fuel injectors are each fluidly connected to one of the outlets from the common rail. An electronically controlled pump includes an outlet fluidly connected to the inlet of the common rail. An electronic controller is in control communication with each of the plurality of fuel injectors and the electronically controlled pump. A rail pressure sensor is in communication with the electronic controller. The electronic controller includes a rail pressure control algorithm configured to generate pump control signals responsive to sensed rail pressure data. A pump control signal is predominantly responsive to the error difference between an actual rail pressure and a target rail pressure when outside of an overshoot avoidance condition corresponding to the error being less than a first threshold and a time rate of change of the error being greater than a second threshold. The pump control signal is predominantly responsive to the time rate of change error during the overshoot avoidance condition.

DETAILED DESCRIPTION

Figure 1:
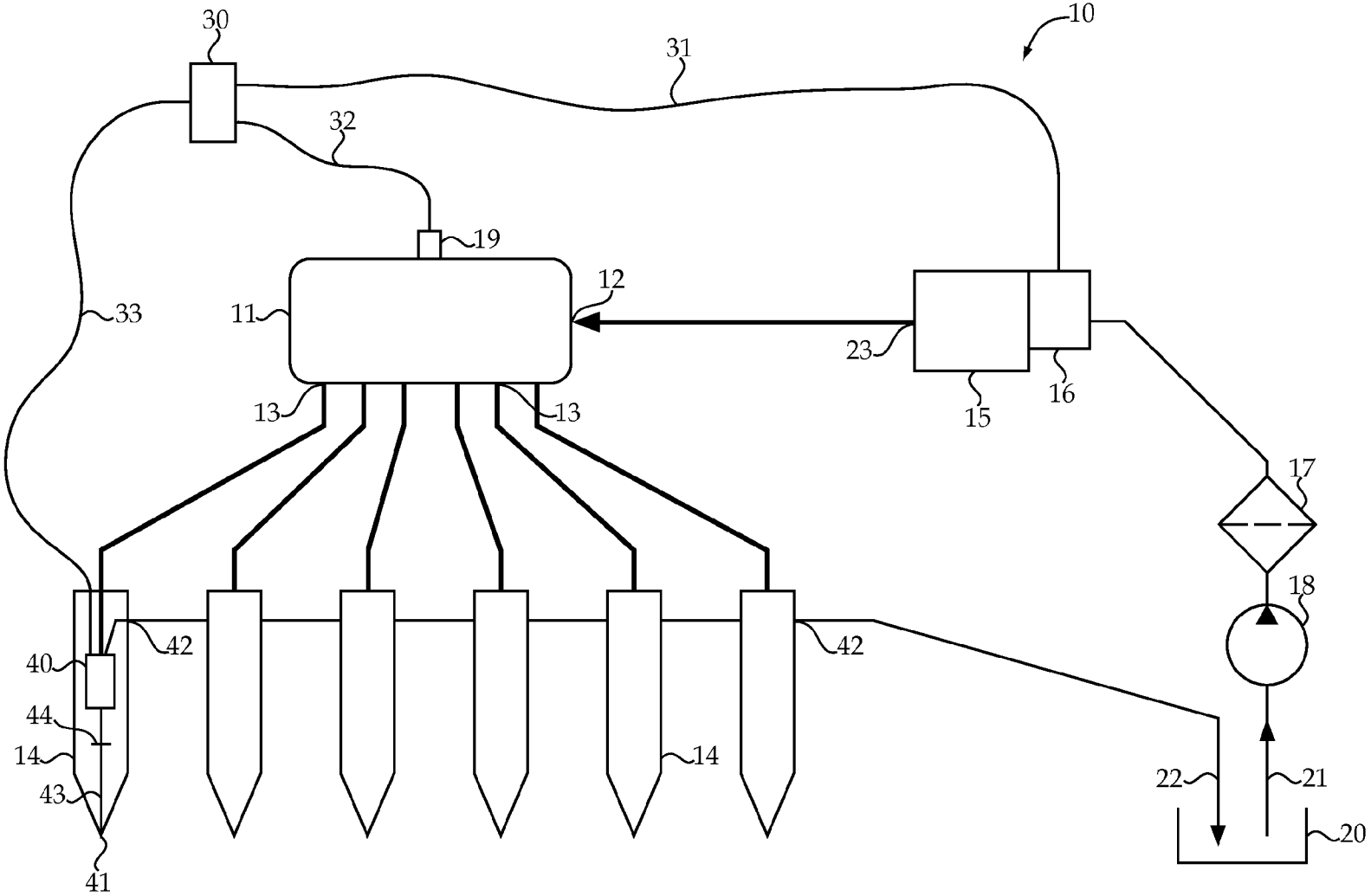
FIG. 1 is a schematic view of a common rail fuel system according to the present disclosure.

Referring to FIG. 1, a common rail fuel system 10 includes a high pressure common rail 11 with an inlet 12 fluidly connected to an outlet 23 of an electronically controlled pump 15. Common rail 11 also includes a plurality of outlets 13 that are each fluidly connected to one of a plurality of fuel injectors 14. A fuel tank 20 includes an outlet 21 fluidly connected to an electronically controlled throttle inlet valve 16 of electronically controlled pump 15. In particular, a low pressure pump 18 draws fuel from tank 20, and pushes the fuel through a filter 17 on its way to electronically controlled pump 15. Thus, the output from pump 15 is controlled by changing a flow area through throttle inlet valve 16. Nevertheless, other electronically controlled high pressure pumps that control output in different ways would also fall within the scope of the present disclosure. For instance, other pumps might include outlet spill controlled pumps, variable displacement pumps and others known in the art. Each of the fuel injectors 14 includes a drain outlet 42 fluidly connected to an inlet 22 of fuel tank 20. An electronic controller 30 is in control communication with each of the plurality of fuel injectors 14 and the electronically controlled pump 15 via respective communication lines 33 and 31. A rail pressure sensor 19 provides rail pressure information to electronic controller 30 via a communication line 32.

All of the fuel injectors 14 are identical, but the fuel injector 14 at the left end schematically shows a control valve 40 that controls pressure on a closing hydraulic surface 44 of a direct operated check 43 to open and close nozzle outlets 41 to facilitate fuel injection events. During injection events, some small amount of fuel used for the control process leaves injector 14 through drain outlet 42. Thus, fuel is supplied to common rail 11 exclusively by electronically controlled pump 15, but removed from common rail 11 by each of the fuel injectors 14, with a majority of the fuel removed by being sprayed through nozzle outlets 41 and a lessor control fluid amount being removed through drain outlets 42. Control valve 40 can be any of a variety of two way or three way valves known in the art. However, control valve 40 is preferably configured to seal a fluid connection between common rail 11 and drain outlet 42 between injection events. This feature along with appropriate guide clearances and guide lengths within fuel injectors 14 between high pressure and low pressure areas help to characterize fuel injectors 14 as being so called "zero leak" fuel injectors. In other words, fuel injectors 14 might leak little to no fuel between injection events, but fuel injectors that exhibited some substantial amount of leakage could also fall within the scope of the present disclosure. Those skilled in the art will appreciate that zero leak fuel injectors can cause the fuel system 10 to exhibit substantial stiffness in rail 11 due to the near incompressibility of liquid fuels, such as distillate diesel fuel. Thus, fuel system 10 might be associated with a compression ignition engine, but the teachings of the present disclosure could also find potential application, in gasoline common rail systems associated with spark ignited engines.

Those skilled in the art will appreciate that any change in the flow to or out from common rail 11 can create a significant variation in rail pressure. When this factor is coupled with the use of an electronically controlled pump that utilizes an inlet throttle valve 16 with a significant time constant and hysteresis, controlling within set specification can become problematic. The slow nature of the inlet throttle valve 16 in responding to control inputs can create excessive pressure overshoot when utilizing conventional proportional integrator controllers of a type well known in the art. Thus, without improvements taught by the present disclosure, control system 10 would have to compromise on rail pressure response times, and hysteresis in the inlet throttle valve 16 could create sustained oscillations in rail pressure. This might be due to the fact that a conventional proportional integrator controller and the actuator are always at a state of under or over correction. Depending upon how much hysteresis exists, controlling the rail pressure in the common rail 11 within certain bounds can be difficult. The present disclosure addresses these issues by equipping electronic controller 30 to include an improved rail pressure controller algorithm 50 with special logic to provide fast response times when a rail pressure error is relatively large, while inhibiting pressure overshoot when the sensed or actual rail pressure is changing quickly in a vicinity of a target rail pressure.

The present disclosure teaches the use of a rail pressure error derivative to apply damping when the sensed or actual rail pressure is changing fast in the vicinity of the target rail pressure. In essence, the method of the present disclosure departs from conventional proportional integrator controllers by determining how fast the sensed rail pressure is approaching the target rail pressure, how long the rate of change has been sustained and how close the sensed rail pressure is to the target rail pressure to determine when to apply damping. In one application strategy, one can set a threshold level on a rail pressure error derivative. In the event that the electronic controller 30 determines that the rail pressure error derivative to beyond this threshold for a reasonable amount of time, the controller might then check to determine if the rail pressure error (difference between sensed rail pressure and target rail pressure) is less than another threshold. If so, electronic controller 30 may command the electronically controlled pump 15 in an opposing direction of the rail pressure error derivative in order to slow down the rate of rise or fall in the rail pressure. This strategy may be employed when the rail pressure error and rail pressure error derivative indicate that the system 10 is in an overshoot avoidance condition defined by the thresholds. One strategy for carrying out this logic could be utilizing gain scheduling techniques known in the art with regard to proportional integrator derivative controllers.

Figure 2:
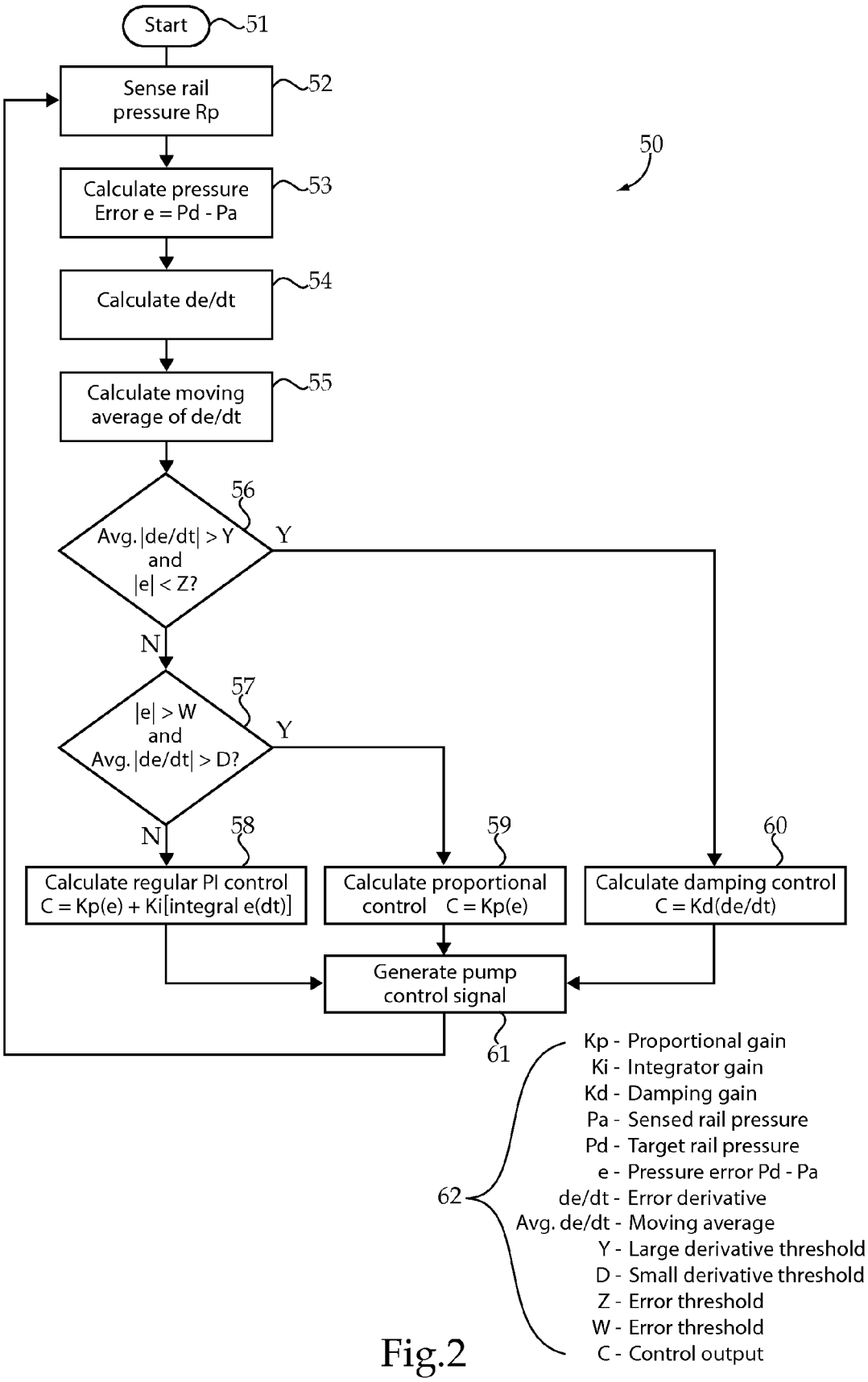
FIG. 2 is a logic flow diagram of a rail pressure control algorithm according to one aspect of the present disclosure.

Referring now to FIG. 2, a logic flow diagram for a rail pressure control algorithm 50 according to the present disclosure is illustrated. Those skilled in the art will appreciate that the logic expressed by the rail pressure control algorithm 50 could be encoded for execution by a processor of electronic controller 30 in a wide variety of ways without departing from the present disclosure. At oval 51, the algorithm starts. At box 52, the rail pressure is sensed, such as by electronic controller 30 reading a signal originating from rail pressure sensor 19. At box 53, a pressure error is calculated, which is essentially the difference between the target rail pressure $P_d$ and the actual or sensed rail pressure $P_a$. By buffering past values of the rail pressure error e, one can calculate at box 54 the time rate of change of the error, or the error derivative de/dt. At box 55, algorithm 50 may calculate a moving average of the error derivative. This strategy might be useful in filtering noise out of the time rate of change data. Those skilled in the art will appreciate that other strategies besides calculating a moving average of the error derivative de/dt could also be employed without departing from the present disclosure. At query 56, the rail pressure control algorithm 50 determines whether the system is in an overshoot avoidance condition. This is accomplished by determining whether the absolute value of the moving average of the error derivative is greater than a large derivative threshold Y, and the absolute value of the error e is less than a small error threshold Z. If algorithm 50 determines that system 10 is in an overshoot avoidance condition, the logic advances to box 60 where the control output C is calculated by multiplying the error derivative de/dt by a damping gain $K_d$. Next, this control output C is utilized to generate a pump control signal at box 61 that is communicated to the electronically controlled throttle inlet valve 16 of pump 15 by electronic controller 30 via communication line 31. The logic would then loop back to box 52 to again sense the rail pressure $R_p$. Depending upon the processor speed, this loop may be executed such as on a frequency of maybe every 15 milliseconds.

Returning to query 56, if the query returns a negative result, then the logic advances to query 57 to determine whether system 10 is in a fast response condition. At query 57, if the absolute value of the error e is greater than a large error threshold W, and the absolute value of the moving average of the error derivative de/dt is greater than a small derivative threshold D, then the logic advances to box 59 to calculate a proportional control output C that equals a proportional gain $K_p$ multiplied by the error e. This control output C is then converted into a pump control signal at box 61 that is communicated to electronically controlled pump 15. Next, the logic would again loop back to sense rail pressure again at box 52.

If the queries 56 and 57 determine that the system 10 is in a normal condition, meaning that the system condition is neither an overshoot avoidance condition nor a quick response condition, the logic advances to box 58 where a regular proportional integrator control output c is calculated by multiplying the error e times the proportional gain $K_p$ and adding that term to an integrator gain $K_i$ multiplied by the integral of the error over time in a conventional manner. This control output C is then converted to a pump control signal at box 61 that is again communicated to electronically controlled pump 15.

Thus, the rail pressure control algorithm 50 is configured to generate pump control signals responsive to sensed rail pressure data. The pump control signal will predominantly be responsive to an error difference between the actual rail pressure and a target rail pressure when outside of an overshoot avoidance condition corresponding to the error e being less than a first threshold Z, and a time rate of change of the error de/dt being greater than a second threshold Y. However, the pump control signal will be predominantly responsive to the time rate of change of the error de/dt during the overshoot avoidance condition. Although box 60 shows the control output C being calculated exclusively based upon the time rate of change of the error de/dt, indicating in terms of a PID controller that the $K_p$ and the $K_i$ gains are zero during the overshoot avoidance condition, those gains need not necessarily be zero. In other words, predominantly does not necessarily mean exclusively as in the illustrated embodiment. However, in the illustrated embodiment, the gain scheduling could be utilized during the overshoot avoidance condition to set the $K_i$ and $K_p$ gains in a PID controller to zero in one embodiment of the present disclosure.

The pump control signal may be predominantly responsive to the error e and the integral of the error when in a normal condition outside of a fast response condition corresponding to the error e being greater than a third threshold W, and the time rate of change of the error de/dt being greater than a fourth threshold D. However, as shown in box 59, the pump control signal is predominantly responsive to the error e during the fast response condition. Again, if the logic of algorithm 50 is executed by way of a PID controller, the $K_i$ and $K_d$ gains could be set to zero during the fast response condition at box 59. However, predominantly does not necessarily mean exclusively, such that non-zero gains could also fall within the scope of the present disclosure. Thus, one way of implementing the logic of the present disclosure could be to use a proportional integrator derivative (PID) controller utilizing known gain scheduling techniques at each of the overshoot avoidance condition, a normal condition and a fast response condition using a proportional gain $K_p$, an integrator gain $K_i$ and a derivative $K_d$ that have different values in each one of the different conditions. Apart from the descriptions in this text, FIG. 2 includes a legend 62 defining each of the different symbols and variables used in the example logic flow diagram of the rail pressure error control algorithm 50.

INDUSTRIAL APPLICABILITY

The present disclosure finds potential application in any common rail fuel system. The rail pressure algorithm strategy of the present disclosure finds particular application in fuel systems for compression ignition engines, especially those utilizing a high pressure pump that exhibits some hysteresis. The present disclosure is also specifically applicable to cases utilizing low leak or zero leak fuel injectors causing excessive stiffness in the fluid system constituting the common rail fuel system 10. Finally, the present disclosure is particularly applicable to common rail fuel systems in which pressure conditions are fluctuating rapidly and the target rail pressure can quickly change from a first target rail pressure to a second target rail pressure. Finally, the present disclosure is particularly applicable to high pressure systems, such as those associated with compression ignition engines where fuel injection quantities are highly sensitive to instantaneous rail pressure at the time of a fuel injection event.

Figure 3:
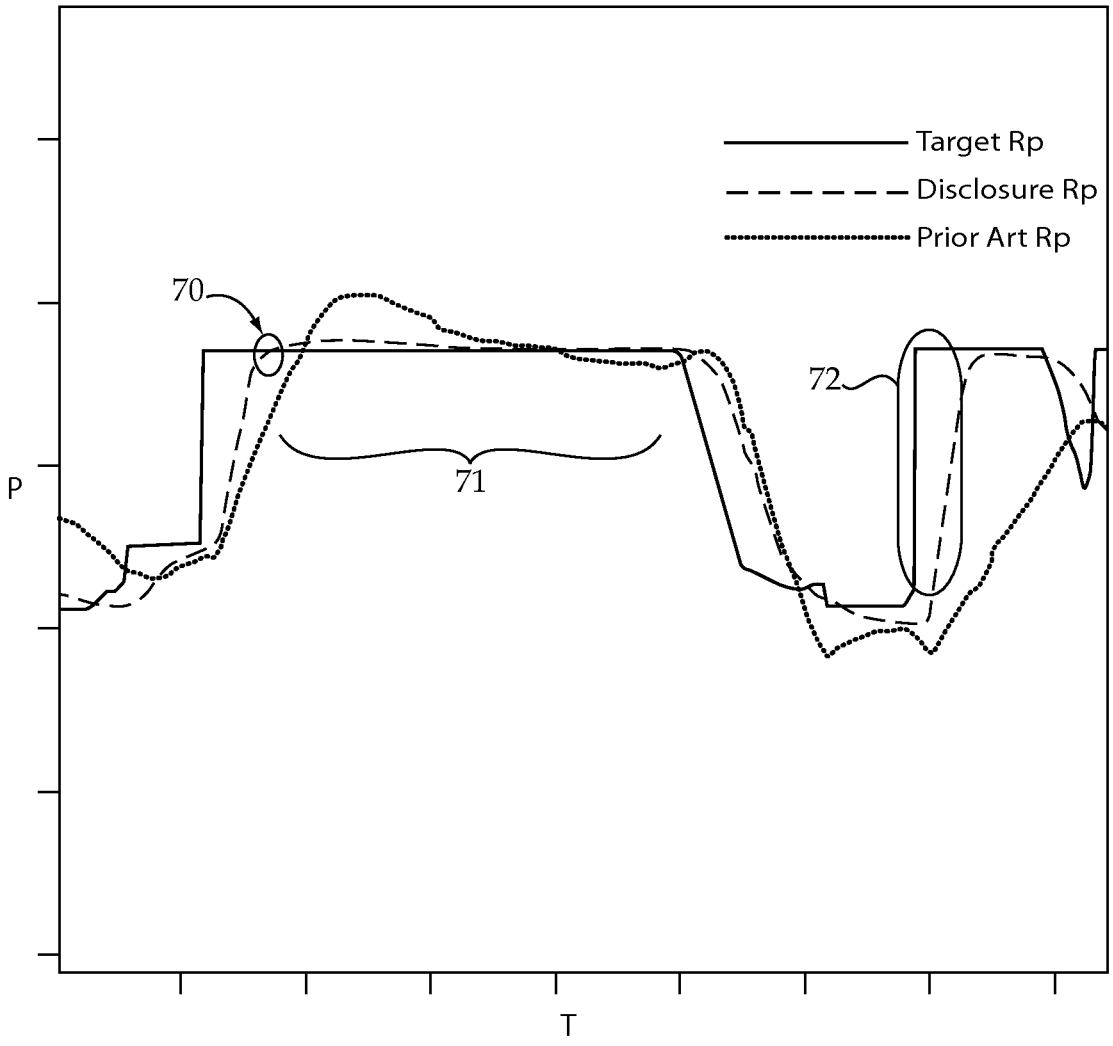
FIG. 3 is a graph of target rail pressure verses time along with actual rail pressure controlled according to both the prior art and the strategy of the present disclosure.

Referring to all of the FIGS. 1-3, and especially FIG. 3 where an example trace of target rail pressure is shown traced with actual rail pressure controlled according to the present disclosure and rail pressure controlled according to a prior art strategy are shown for comparison. When in operation, control of pressure in common rail 11 of common rail fuel system 10 is accomplished by determining an error between actual rail pressure and target rail pressure (box 53, and also determining a time rate of change of the error to de/dt (boxes 54 and 55). While this is occurring, fuel is supplied to common rail 11 from the electronically controlled pump 15, while fuel is removed from the common rail 11 responsive to injecting the fuel from the fuel injectors 14 through the nozzle outlets 41 and also due to routing some fuel utilized for the control aspect through drain outlet 42 during an injection event. Between injection events, the plurality of fuel injectors 14 may seal against leakage of fuel using a variety of means including appropriate sealing lands, appropriately shaped valve seats be they flat or conical, appropriate valve member pre-load biases, appropriate guide clearances in areas where moving parts exist in the fuel injector between high and low pressure areas as well as the length of those guide clearances, by appropriate loading of the various components comprising the injector stack of the injector body and other means known in the art.

In the illustrated embodiment, pressure in the common rail 11 is controlled by controlling an output from electronically controlled pump 15. In the illustrated embodiment, the output from pump 15 may be controlled by changing an inlet flow area of pump 15 by way of electronically controlled inlet throttle valve 16. Although the present disclosure is illustrated in the context of rail pressure control by controlling output from the electronically controlled pump 15, systems that utilize a separate rail pressure control valve to occasionally and briefly fluidly connect the common rail 11 to tank 20, as well as systems that utilize non-injection event actuation of fuel injectors 14 to control pressure in common rail 11 could also fall within the scope of the present disclosure.

When in an overshoot avoidance condition, such as time 70 in FIG. 3, pressure in common rail 11 is controlled predominantly responsive to the time rate of change of the error de/dt. In the illustrated embodiment, the output of pump 15 is controlled exclusively responsive to the time rate of change of the error during the overshoot avoidance condition. This can be done because the overshoot avoidance condition only occurs when the error is small and the time rate of change of the error is relatively large, which could lead to an overshoot condition if the error derivative is not damped. When operating in a relatively normal condition outside of the overshoot avoidance condition, the pressure in common rail 11 is controlled predominantly responsive to the error and maybe the integral of the error, but without regard to the time rate of change of the error de/dt. Thus, for instance, during time period 71, if the strategy of the present disclosure is implemented using gain scheduling, the $K_d$ or derivative gain might be zero in zone 71. Moreover, during the normal condition corresponding the time period 71, the algorithm will continue to determine a running integral of the error, and control pressure in the common rail 11 predominantly responsive to the error e and the integral of the error during normal operating conditions, such as when the error is relatively smaller and the error derivative is also relatively small. However, when operating in a fast response condition, such as that associated time 72 shown in FIG. 3, the pressure in common rail 11 may be controlled predominantly responsive only to the error. This strategy avoids circumstances where the integral of the error might hinder a faster response. The fast response condition may correspond to the time period immediately following a change of the target rail pressure from a first target rail pressure to a second target rail pressure that is substantially different, and involves a substantial desired change in rail pressure such as what might occur when an engine abruptly changes speed or load.

Thus, the present disclosure teaches that in order to address an overshoot issue, one might create gain scheduling in a PID controller in which the proportional and integral gains yield to the derivative gain during certain specific conditions, such as when the error is small but the error derivative is large. The strategy may utilize the error derivative and other parameters to decide how much damping to use and when exactly to apply this damping. For example, when the desired or target rail pressure changes abruptly in a step, one could theoretically expect proportional and integral terms to push the actual rail pressure toward the target rail pressure. However, the hardware constraints associated with the hysteresis of the electronically controlled pump 15 and the stiffness of the system 10 due to the low leakage fuel injectors 14 allow the threshold levels to be set on the error derivative and the error to determine when to apply damping. In the illustrated embodiment, when a threshold level of the error derivative is exceeded for a reasonable amount of time, which may be due to the use of a running average, and the absolute error is close enough to the target rail pressure, damping is employed.

On the integral front, the present disclosure would teach the use of integral gains Ki if the actual rail pressure is very far from the target rail pressure and also if the error derivative is high. Several issues may be addressed by the method of the present disclosure. By using a the error derivative under certain conditions, and by utilizing a running average of the same, the problems of noise feeding into the controller may be reduced or eliminated. By using gain scheduling approach, the logic utilizes an established and proven strategy but in a different way from how gain scheduling is typically employed. This may be important for stability. By applying at the right moment and not using the error derivative gain all the time nor using the integral gain all the time, one can avoid slowing down the response time. By changing the integral gains as previously taught based upon the different conditions (normal, overshoot avoidance condition and fast response condition) the integral of the error may only substantially be used during steady state errors. With regard to hysteresis, it is common knowledge that hysterics in actuators can cause sustained oscillations. The present disclosure addresses this issue by operating on the corresponding hysteretic curve direction in the flow curve provided by the throttle inlet valve 16 specifications. This method may be based upon an assumption that, depending upon the direction of the rail pressure error, that is whether the rail pressure error e is increasing or decreasing, the future control input to the input throttle valve 16 will also be increasing or decreasing. This information along with others like fuel temperature, flow quantity and the hysteric flow curve may help provide enough instantaneous off set in control input to ride along the forward or return side of the hysteric flow curve. This may eliminate excess time taken by the controller 30 to slowly catch up and, depending upon the accuracy of the flow curve. In addition, sustained oscillations in the system 10 may be reduced and possibly removed.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A method of controlling pressure in a common rail of a fuel common rail system comprising the steps of:

determining an error between an actual rail pressure and a target rail pressure;

determining a time rate of change of the error;

determining an integral of the error;

determining, based on the error and the time rate of change of the error, whether the common rail system is in one of an overshoot avoidance condition and a fast response condition, wherein the overshoot avoidance condition is indicated by the error being less than a first threshold and the time rate of change of the error being greater than a second threshold, the fast response condition is indicated by the error being greater than a third threshold and the time rate of change of the error being greater than a forth threshold;

supplying fuel to the common rail from an electronically controlled pump;

removing fuel from the common rail responsive to injecting fuel from a plurality of fuel injectors;

controlling pressure in the common rail predominately responsive to the time rate of change of the error during the overshoot avoidance condition, and predominantly responsive to the error during the fast response condition, and predominately responsive to the error and the integral of the error when the common rail system is operating in neither the overshoot avoidance condition nor the fast response condition.

2. The method of claim 1 wherein the steps of controlling pressure in the common rail includes controlling an output of the electronically controlled pump.

3. The method of claim 2 wherein the step of controlling the output of the electronically controlled pump includes changing an inlet flow area of the pump.

4. The method of claim 1 including a step of sealing each of the plurality of fuel injectors against leakage of fuel between injection events; and the removing fuel step includes injecting fuel from a nozzle outlet and routing fuel through a drain outlet during an injection event for each of the plurality of fuel injectors.

5. The method of claim 1 including a step of filtering noise out of time rate of change data by calculating a moving average of the time rate of change of the error.

6. The method of claim 1 including a step of changing from a first target rail pressure to a second target rail pressure.

7. The method of claim 6 wherein the steps of controlling pressure in the common rail includes controlling an output of the electronically controlled pump;

the step of controlling the output of the electronically controlled pump includes changing an inlet flow area to a pumping chamber of the pump;

sealing each of the plurality of fuel injectors against leakage of fuel between injection events; and the removing fuel step includes injecting fuel from a nozzle outlet and routing fuel through a drain outlet during an injection event for each of the plurality of fuel injectors.

8. The method of claim 7 including a step of filtering noise out of time rate of change data by calculating a moving average of the time rate of change of the error.

9. A common rail fuel system comprising:

a common rail with an inlet and a plurality of outlets;

a plurality of fuel injectors, each fluidly connected to one of the outlets from the common rail;

an electronically controlled pump with an outlet fluidly connected to the inlet of the common rail;

an electronic controller in control communication with each of the plurality of fuel injectors and the electronically controlled pump;

a rail pressure sensor in communication with the common rail and the electronic controller;

wherein the electronic controller includes a rail pressure control algorithm configured to receive rail pressure data from the rail pressure sensor and determine that the common rail fuel system is operating in one of an overshoot avoidance condition, a fast response condition, and a normal condition based on an error between an actual rail pressure and a target rail pressure and a time rate of change of the error, the overshoot avoidance condition indicated by the error being less than a first threshold and the time rate of change of the error being greater than a second threshold, the fast response condition indicated by the error being greater than a third threshold and the time rate of change of the error being greater than a forth threshold, the normal condition indicated by being neither the overshoot avoidance condition nor the fast response condition, and wherein the electronic controller is configured to generate a pump control signal responsive to sensed rail pressure data, wherein the pump control signal being predominantly responsive to the time rate of change of the error during the overshoot avoidance condition, predominantly responsive to the error during the fast response condition, and predominately responsive to the error and the integral of the error when the common rail system is operating in the normal condition.

10. The common rail fuel system of claim 9 including a fuel tank with an outlet fluidly connected to an electronically controlled throttle inlet valve of the electronically controlled pump, and an inlet fluidly connected to a drain outlet of each of the plurality of fuel injectors.

11. The common rail fuel system of claim 9 wherein the rail pressure control algorithm includes a proportional integrator derivative controller with gain scheduling; and wherein each of the fast response condition, the overshoot avoidance condition and a normal condition has a different set of a proportional gain, an integrator gain and a derivative gain.

12. The common rail fuel system of claim 10 wherein each of the fuel injectors includes means for avoiding fuel leakage to the drain outlet between injection events.

13. The common rail fuel system of claim 11 wherein the derivative gain is zero during the normal condition and the fast response condition.

14. The common rail fuel system of claim 13 wherein the integrator gain is zero during the fast response condition.

* * * * *